US005707766A

United States Patent [19]

Nogami et al.

[11] Patent Number: 5,707,766

[45] Date of Patent: Jan. 13, 1998

[54] ELECTROPHOTOGRAPHIC PHOTOSENSITIVE MATERIAL

[75] Inventors: Sumitaka Nogami; Michihiro Kitazawa, both of Kawasaki, Japan

[73] Assignee: Fuji Electric Co., Ltd., Kawasaki, Japan

[21] Appl. No.: 521,741

[22] Filed: Aug. 31, 1995

[30] Foreign Application Priority Data

Sep. 1, 1994 [JP] Japan ..... 6-208352

[51] Int. Cl.[6] ..... G03G 5/04; G03G 5/047

[52] U.S. Cl. ..... 430/58; 430/59; 430/83

[58] Field of Search ..... 430/58, 59, 83

[56] References Cited

U.S. PATENT DOCUMENTS

| | | | |
|---|---|---|---|
| 4,943,501 | 7/1990 | Kinoshita et al. | 430/58 |
| 5,171,651 | 12/1992 | Takaoka et al. | 430/59 |
| 5,286,588 | 2/1994 | Suzuki | 430/58 |
| 5,308,727 | 5/1994 | Osawa et al. | 430/59 |
| 5,380,613 | 1/1995 | Ueda et al. | 430/58 |
| 5,474,868 | 12/1995 | Adachi et al. | 430/83 |

FOREIGN PATENT DOCUMENTS

| | | |
|---|---|---|
| 0 451 761 | 10/1991 | European Pat. Off. . |
| 0 506 387 | 9/1992 | European Pat. Off. . |
| 47-18545 | 9/1972 | Japan . |
| 47-30328 | 11/1972 | Japan . |
| 48-25658 | 7/1973 | Japan . |
| 49-105537 | 10/1974 | Japan . |
| 57-122444 | 7/1982 | Japan . |
| 60-15541 | 1/1985 | Japan . |
| 61-143763 | 7/1986 | Japan . |
| 62-105151 | 5/1987 | Japan . |
| 63-47631 | 2/1988 | Japan . |
| 1-118137 | 5/1989 | Japan . |

OTHER PUBLICATIONS

Kazuo Yamaguchi et al. "Polymeric Materials Science and Engineering", 1993, American Chemical Society, vol. 68, pp. 287–288.

*Primary Examiner*—Roland Martin

*Attorney, Agent, or Firm*—Spencer & Frank

[57] ABSTRACT

An electrophotographic photoconductor includes an electroconductive substrate and a photosensitive layer which is provided on the electroconductive substrate and which includes a charge generating agent, a hole charge transporting agent, and antioxidant composed of at least two antioxidant materials. In a second embodiment, the electrophotographic photoconductor includes an electroconductive substrate and a photosensitive layer which is provided on the electroconductive substrate and which includes a charge generating layer containing a charge generating agent and a charge transporting layer containing a hole charge transporting agent, and antioxidant composed of at least two antioxidant materials.

12 Claims, 1 Drawing Sheet

ELECTROPHOTOGRAPHIC PHOTOSENSITIVE MATERIAL

BACKGROUND OF THE INVENTION

1. Field of the Invention

The present invention relates to an electrophotographic photosensitive material, and more specifically, to an electrophotographic photosensitive material with good durability and highly stable electrical characteristics during repeated use.

2. Description of the Prior Art

Photoconductive materials that have been used in electrophotographic photosensitive materials are inorganic photoconductive materials such as selenium, cadmium sulfide, and zinc oxide, or organic photoconductive materials such as polyvinylcarbazole. As shown in the appended drawing, FIG. 1, single-layered photosensitive materials have a single photosensitive layer 20 containing such a photoconductive material 2 on an electroconductive substrate 1. In recent years, double-layered laminate type photosensitive materials have been developed and put to practical use. Photosensitive materials of the latter type have a photosensitive layer with a photoconductive function divided into the function of receiving light and generating charge carriers, and the function of transporting the charge carriers generated. That is, as shown in FIG. 2, they have a photosensitive layer 21 on an electroconductive substrate 1, the layer being a laminate consisting of a charge generation layer 4 containing a charge generating substance 3 which functions to receive light and generate charge carriers, and a charge transport layer 6 containing a charge transporting substance 5 which functions to transport the charge carriers generated.

Organic photoconductive materials have many advantages, such that wide varieties of materials are available and can be chosen according to requirements; film formation is easy for the production of photosensitive materials; the resulting film is flexible; and they are economical. Because of these advantages, research and development have been energetically performed, and organic photosensitive materials using these materials have found actual use. Known examples include a photosensitive material having a single photosensitive layer of a charge transfer complex formed of a combination of vinylcarbazole and trinitrofluorenone as described in U.S. Pat. No. 3,484,237; a photosensitive material having a dye sensitized photosensitive layer as shown in Japanese Patent Application Publication No. 25658/1973; photosensitive materials having a single photosensitive layer containing a pigment dispersed in a hole transfer agent or an electron transfer agent as shown in Japanese Patent Application Laid-Open Nos. 30328/1972 and 18545/1972; and a photosensitive material having a double-layered laminate type photosensitive layer consisting mainly of a charge generation layer and a charge transport layer laminated together as disclosed in Japanese Patent Application Laid-Open No. 105537/1974. Of them, a double-layered laminate type photosensitive material is highly likely to give high sensitivity and excellent characteristics by forming the respective layers from materials optimal for their respective functions, and combining them together. Thus, eager development is under way for this type of photosensitive material.

In electrophotographic devices, a photosensitive material is usually subjected to cycles of steps, such as corona charge, image exposure, development, transfer and cleaning, to obtain an image. During this period, the photosensitive material is required to exhibit stable characteristics. Organic photosensitive materials hitherto obtained, however, have not been fully satisfactory in terms of the stability of characteristics and durability during repeated usage. Repeated use has caused a decrease in surface potential (deterioration of charge properties), arousing a decrease in image density, and eventually making the photosensitive material unserviceable.

The cause of such deterioration is unknown, and various factors may be involved. Currently, a plausible explanation is as follows: Corona discharge is known to generate active gases such as ozone and $NO_x$. During image formation, the photosensitive material is constantly exposed to an atmosphere of corona discharge. Thus, its deterioration proceeds under the influence of those gases.

To avoid this influence, electrophotographic devices adopt a means for dispelling gases from around the corona charger. However, it is difficult to remove these gases completely.

The aforementioned double-layered laminate type photosensitive material shown in FIG. 2, in particular, often has a structure in which a charge transport layer 6 is provided on a thin charge generation layer 4 to protect it. With the organic charge transporting agent now in use, normally holes travel as charge carriers, and the photosensitive material of the above-mentioned structure is used negatively charged. A negative corona discharge generates large amounts of active gases such as ions and $NO_x$, making the problem of deterioration even more serious.

As a method of preventing this problem, it has been known to add various antioxidants to the photosensitive layer. For example, Japanese Patent Application Laid-Open No. 122444/1982 proposes hindered phenols, Japanese Patent Application Laid-Open No. 143763/1986 puts forward the addition of large amounts of hindered phenols, and Japanese Patent Application Laid-Open No. 105151/1987 proposes hindered phenols of a specific structure. As examples using hindered amines, Japanese Patent Application Publication Nos. 27693/1994 and 27694/1994 propose hindered amines and specific electron acceptor compounds.

The use of such antioxidants can prevent to a certain degree the deterioration of the photosensitive material by gases such as ozone and $NO_x$. To satisfy the recent market's demand for long-life photosensitive materials, an enhanced preventive effect is required.

The present invention has been accomplished to meet this demand. It object is to provide a photosensitive material with excellent electrical characteristics and markedly improved stability of characteristics even during long-term repeated use, by adding a specific compound to the layer containing a hole charge transporting agent in a photosensitive layer.

SUMMARY OF THE INVENTION

According to the present invention, the problem set forth above is solved by incorporating the following in a layer containing a hole charge transporting agent at least provided on an electroconductive substrate:

a combination of at least one member selected from hydrobenzoin compounds of the formula ($A_1$) or hydrobenzoin compounds of the formula ($A_2$) (hereinafter collectively referred to as Group A compounds), and at least one member selected from hindered phenols of the formula ($B_1$) or a group of quinones of the formulae ($B_2$) or hydroquinones of the formula ($B_3$) (hereinafter collectively referred to as Group B compounds):

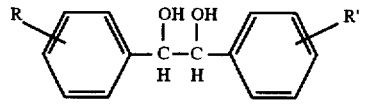

(A1)

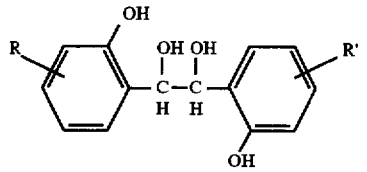

(A2)

where R and R' are different from or the same as each other, and each represent a hydrogen atom, a halogen atom, a cyano group, a nitro group, an alkyl group optionally having a substituent, an alkoxy group optionally having a substituent, an aryl group optionally having a substituent, or an aralkyl group optionally having a substituent.

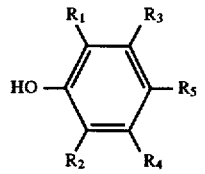

(B1)

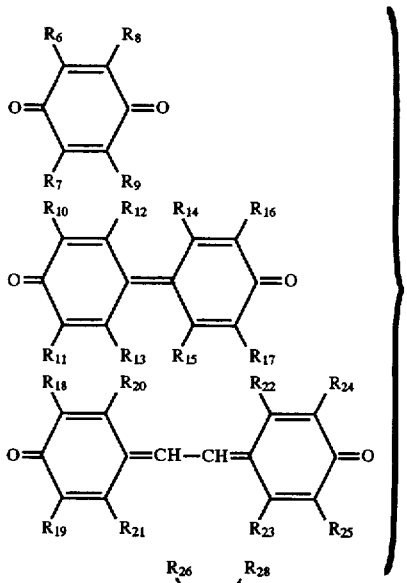

(B2)

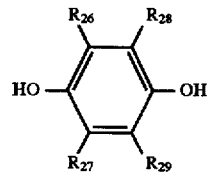

(B3)

where $R_1$ to $R_{29}$ are different from or the same as each other, and each represent a hydrogen atom, a halogen atom, a substituted or unsubstituted alkenyl group, a substituted or unsubstituted aryl group, a substituted or unsubstituted cycloalkyl group, a substituted or unsubstituted alkoxy group, or a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxycarbonyl, alkylacyloxy, arylacyloxy, silyl, or heterocyclic group.

The layer containing the hole charge transporting agent refers to the photosensitive layer 20 in the single-layer type photosensitive material shown in FIG. 1, or the charge transport layer 6 in the laminate type photosensitive material shown in FIG. 2.

In detail, the above-described problem is solved by incorporating in the layer containing the hole charge transporting agent a combination of at least one member selected from hydrobenzoin compounds of the formula ($A_1$) and at least one member selected from hindered phenols of the formula ($B_1$).

The problem is also solved by incorporating in the layer containing the hole charge transporting agent a combination of at least one member selected from hydrobenzoin compounds of the formula ($A_1$) and at least one member selected from a group of quinones of the formulae ($B_2$).

The problem is also solved by incorporating in the layer containing the hole charge transporting agent a combination of at least one member selected from hydrobenzoin compounds of the formula ($A_1$) and at least one member selected from hydroquinones of the formula ($B_3$).

The problem is also solved by incorporating in the layer containing the hole charge transporting agent a combination of at least one member selected from hydrobenzoin compounds of the formula ($A_2$) and at least one member selected from hindered phenols of the formula ($B_1$).

The problem is also solved by incorporating in the layer containing the hole charge transporting agent a combination of at least one member selected from hydrobenzoin compounds of the formula ($A_2$) and at least one member selected from a group of quinones of the formulae ($B_2$).

The problem is also solved by incorporating in the layer containing the hole charge transporting agent a combination of at least one member selected from hydrobenzoin compounds of the formula ($A_2$) and at least one member selected from hydroquinones of the formula ($B_3$).

Examples of the electroconductive substrate according to the present invention include drums or sheets of metals such as aluminum, copper, zinc, nickel or iron, or alloys of these metals; and drums or sheets of paper, plastics or glass having an electroconductive sheet laminated, or a metal deposited, or an electroconductive paint coated, on the surface to obtain electroconductivity. If desired, the surface of the substrate may be oxidized or treated with a chemical, ozone, ultraviolet light or plasma.

Where necessary, the substrate surface may also be provided with an undercoat of a soluble polyamide, casein, polyvinyl alcohol, or urethane.

On the electroconductive substrate is formed a single-layer type photosensitive layer (FIG. 1) containing a pigment and a hole charge transporting agent, or a double-layered laminate type photosensitive layer (FIG. 2) consisting mainly of a charge generation layer mainly containing a pigment, and a charge transport layer mainly containing a hole charge transporting agent, the charge generation layer and the charge transport layer being laminated together, whereby a photosensitive material is constructed. The photosensitive material of the double-layered laminate type is particularly preferred, since it comprises a combination of the respective layers formed of optimal materials for the respective functions. Thus, it is highly likely that the photosensitive material will show excellent characteristics.

The charge generation layer is formed by dispersing a phthalocyanine pigment, an azo pigment, an anthanthrone pigment, a perylene pigment, a perinone pigment, a squalylium pigment, a thiapyrylium pigment, or a quinacridone pigment in an organic solvent together with a binder resin such as polyvinyl butyral, polyvinyl chloride copolymer, acrylic resin, polyester or polycarbonate, and coating the dispersion on the electroconductive substrate. The thickness of the charge generation layer is preferably 0.1 to 2 μm.

The charge transport layer is formed by converting a hole charge transporting agent, such as an enamine compound, a styryl compound, a hydrazone compound or an amine compound, into a solution together with a resin compatible with any of these compounds, such as polyester, polycarbonate, polymethacrylic ester, or polystyrene, adding a specific compound related to the present invention to prepare a coating solution, and coating it onto the charge generation layer. The thickness of the charge transport layer is set at 10 to 40 μm.

The sequence of laminating the charge generation layer and the charge transport layer may be reversed. A photosensitive material having the charge transport layer laminated on the charge generation layer is used negatively charged, while a photosensitive material having the charge generation layer laminated on the charge transport layer is used positively charged.

Of the Group A compounds used in the present invention, hydrobenzoin compounds of the formula ($A_1$) include, for example, the following compounds:

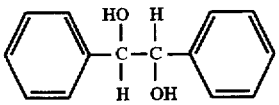
($A_1$-1)

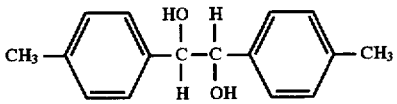
($A_1$-2)

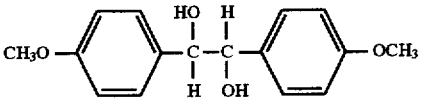
($A_1$-3)

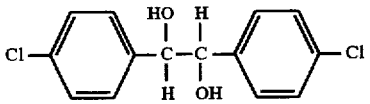
($A_1$-4)

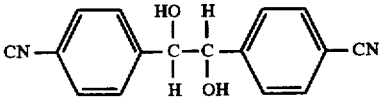
($A_1$-5)

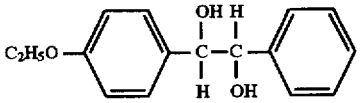
($A_1$-6)

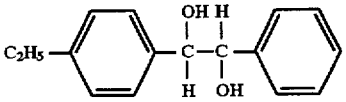
($A_1$-7)

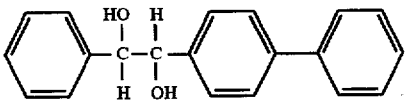
($A_1$-8)

-continued

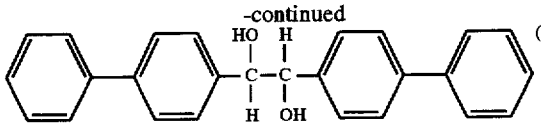
($A_1$-9)

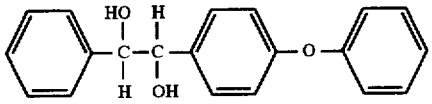
($A_1$-10)

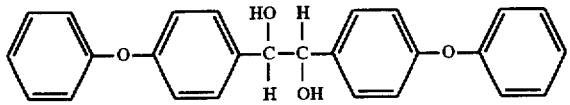
($A_1$-11)

Examples of the hydrobenzoin compounds of the formula ($A_2$) are as follows:

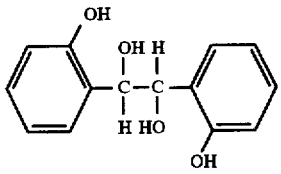
($A_2$-1)

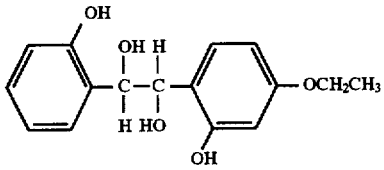
($A_2$-2)

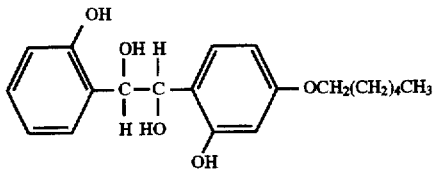
($A_2$-3)

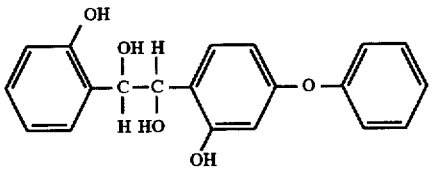
($A_2$-4)

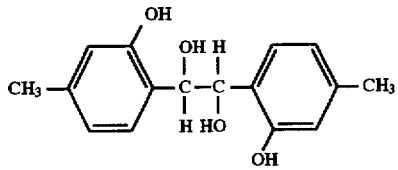
($A_2$-5)

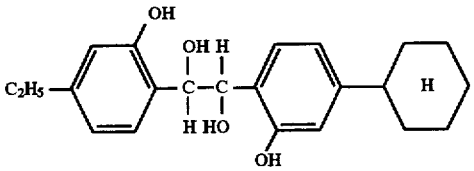
($A_2$-6)

Of the Group B compounds, the hindered phenols expressed by the formula ($B_1$) include, for example, compounds having a phenolic structural unit where bulky atomic groups are present at the ortho-positions with respect to the phenolic hydroxyl group, as illustrated in detail in Japanese Patent Application Laid-Open No. 118137/1989. The bulky atomic groups are branched alkyl groups. Examples of the above compounds are the following:

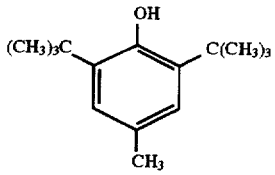
($B_1$-1)
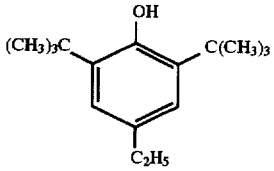
($B_1$-2)
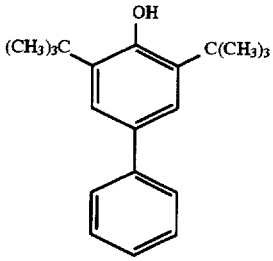
($B_1$-3)
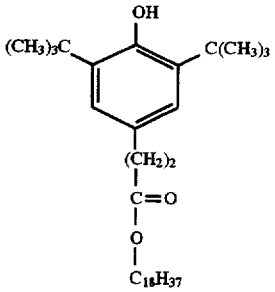
($B_1$-4)
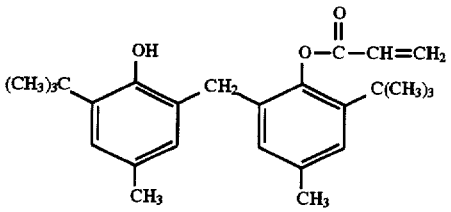
($B_1$-5)
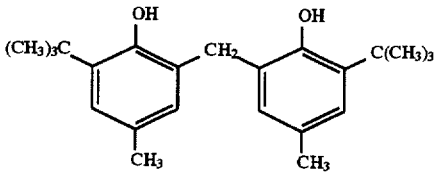
($B_1$-6)
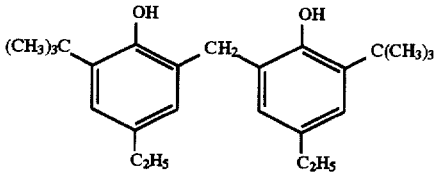
($B_1$-7)

-continued
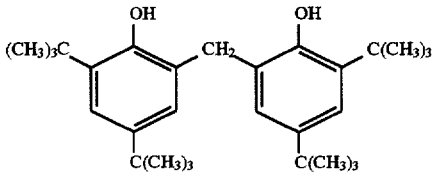
(B1-8)
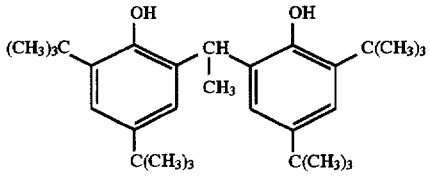
(B1-9)
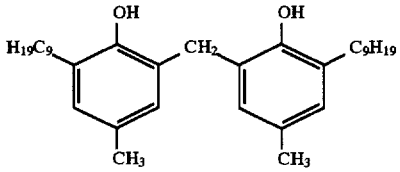
(B1-10)
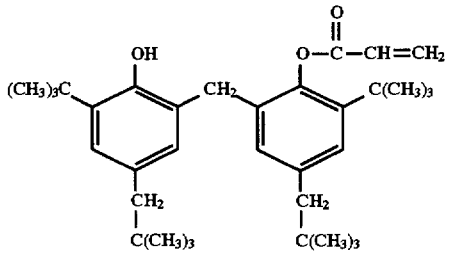
(B1-11)
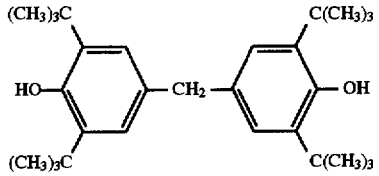
(B1-12)
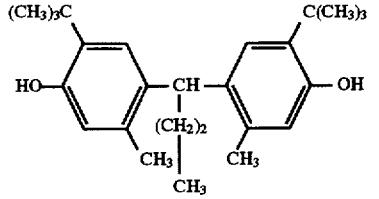
(B1-13)
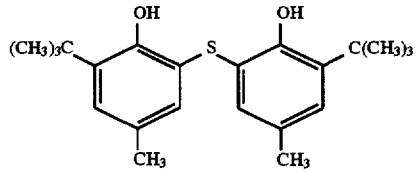
(B1-14)
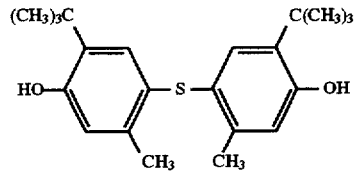
(B1-15)

-continued
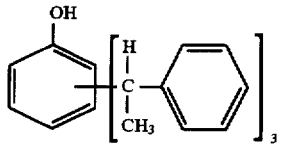
($B_1$-16)
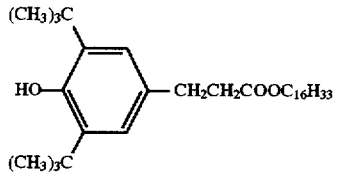
($B_1$-17)
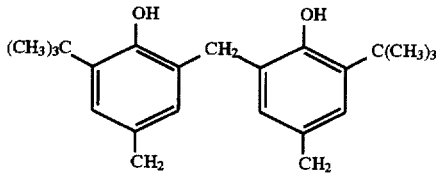
($B_1$-18)
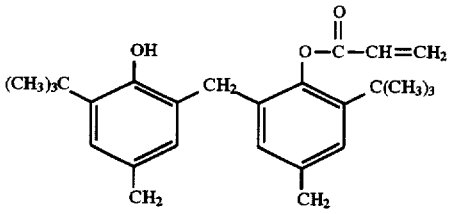
($B_1$-19)
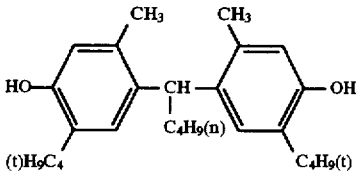
($B_1$-20)
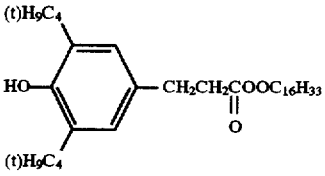
($B_1$-21)
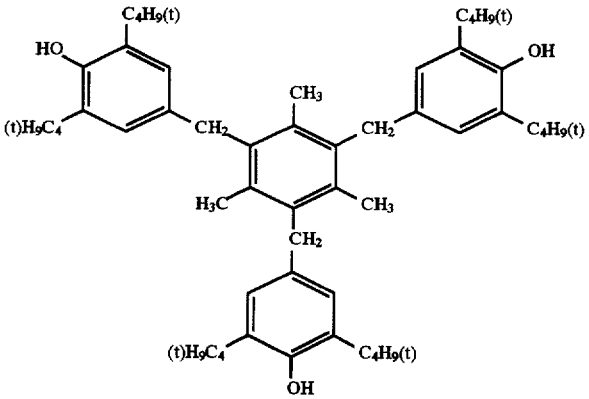
($B_1$-22)

-continued
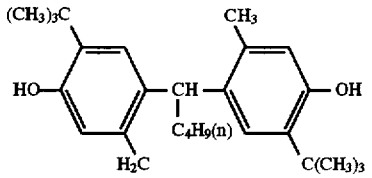
(B1-23)
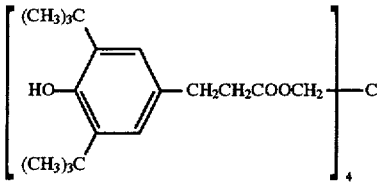
(B1-24)
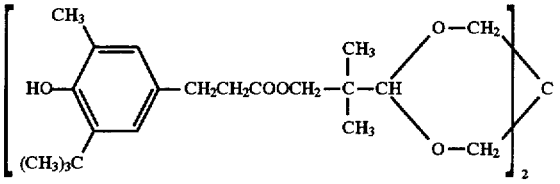
(B1-25)
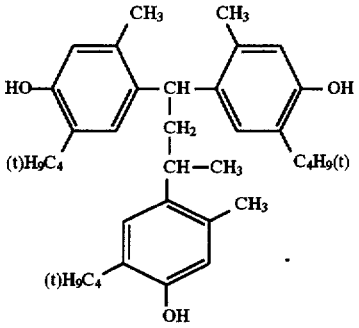
(B1-26)
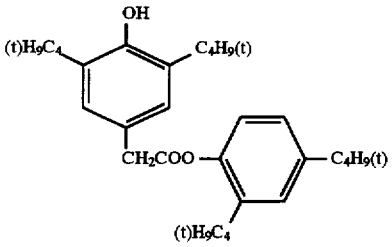
(B1-27)
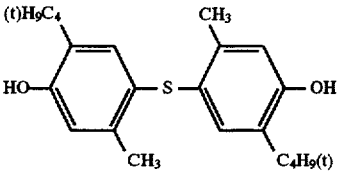
(B1-28)
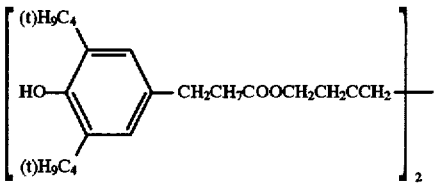
(B1-29)

-continued
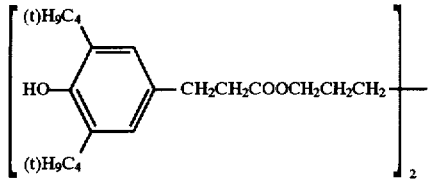
(B1-30)
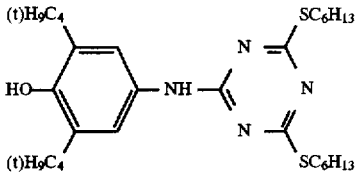
(B1-31)
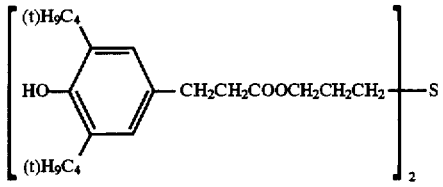
(B1-32)
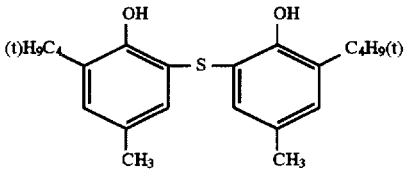
(B1-33)
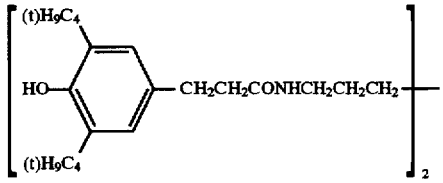
(B1-34)
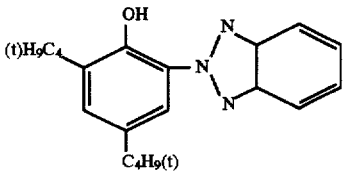
(B1-35)
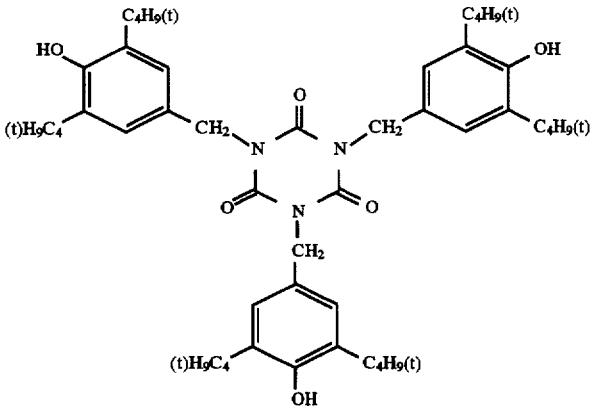
(B1-36)

-continued
(B$_1$-37)
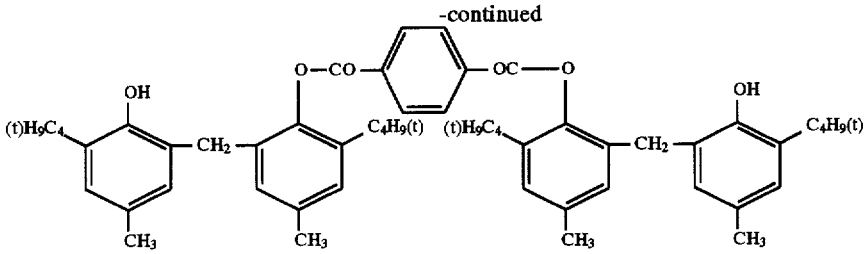
(B$_1$-38)
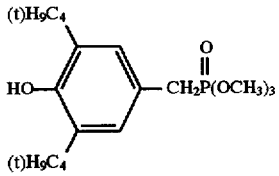
(B$_1$-39)
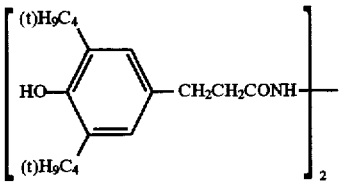
(B$_1$-40)
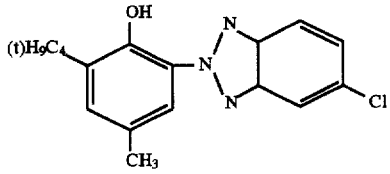
(B$_1$-41)
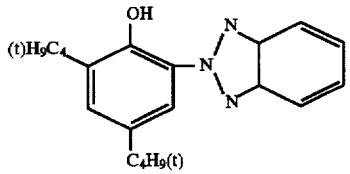
(B$_1$-42)
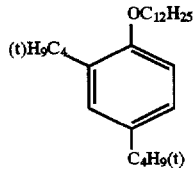
(B$_1$-43)
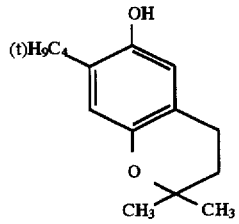
(B$_1$-44)
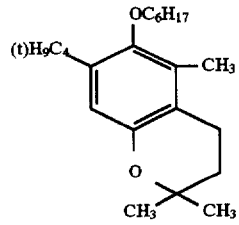

Examples of the quinones, diphenoquinones and stilbenequinones expressed by the formulae ($B_2$) are as follows:
($B_2$-1)
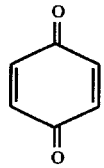
($B_2$-2)
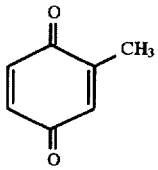
($B_2$-3)
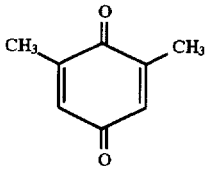
($B_2$-4)
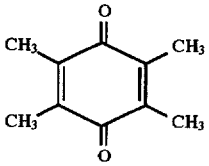
($B_2$-5)
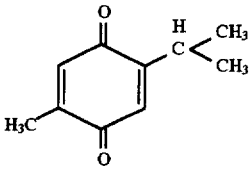
($B_2$-6)
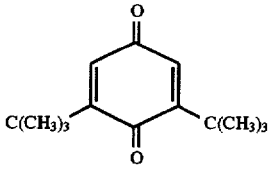
($B_2$-7)
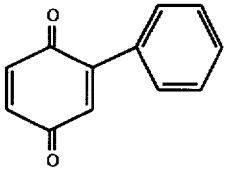
($B_2$-8)
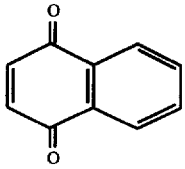
($B_2$-9)
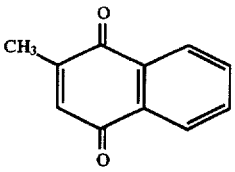
-continued
($B_2$-10)
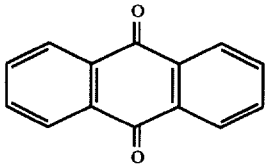
($B_2$-11)
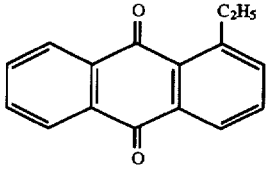
($B_2$-12)
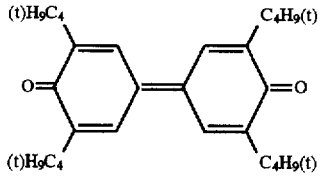
($B_2$-13)
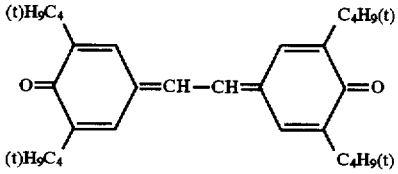
($B_2$-14)
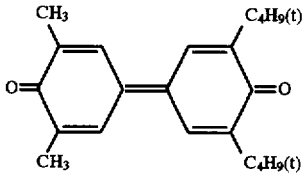
($B_2$-15)
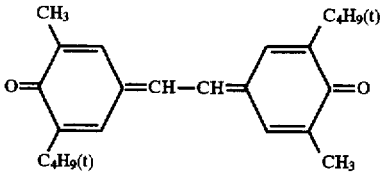
($B_2$-16)
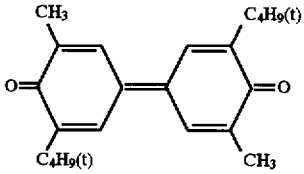
($B_2$-17)
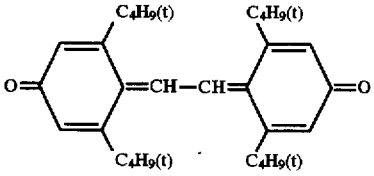
($B_2$-18)
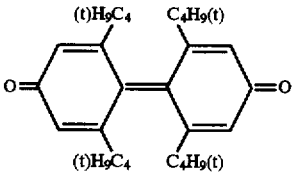

-continued

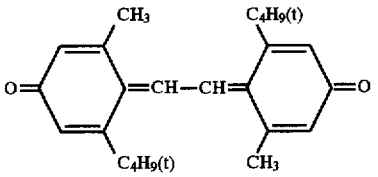

(B2-19)

Examples of the hydroquinones expressed by the formula ($B_3$) are as follows:

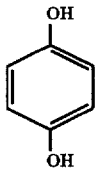

(B3-1)

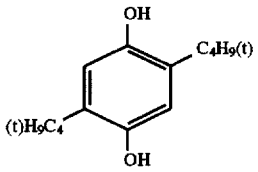

(B3-2)

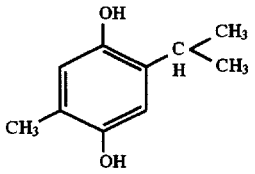

(B3-3)

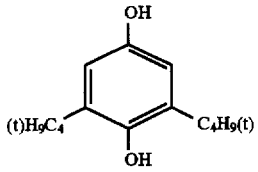

(B3-4)

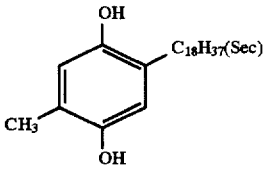

(B3-5)

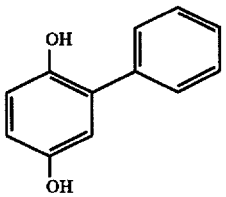

(B3-6)

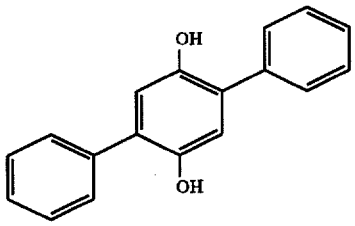

(B3-7)

-continued

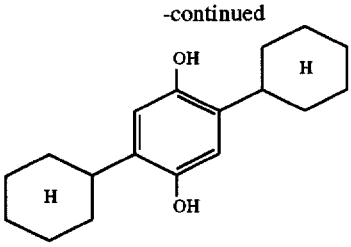

(B3-8)

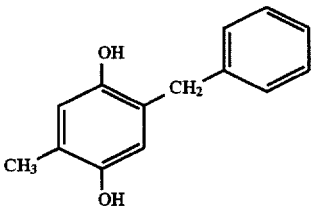

(B3-9)

By incorporating a combination of at least one member selected from the above-described specific Group A compounds and specific Group B compounds into the layer containing the hole charge transporting agent, deterioration of the photosensitive layer can be prevented, and the stability of the photosensitive material can be improved markedly.

The amount of the combination of the Group A compound and Group B compound incorporated into the photosensitive layer is preferably in the range of from 0.1% by weight to 20% by weight of each compound.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below, but it goes without saying that the invention is in no way restricted by these embodiments.

EXAMPLE 1-1

The outside surface of an aluminum cylinder with an outside diameter of 60 mm, a length of 348 mm and a thickness of 1 mm was dip-coated with a coating solution prepared by dissolving 10 parts by weight of a solvent soluble polyamide (CM-8000, Toray Industries, Inc.) in a solvent mixture of 60 parts by weight of methanol and 40 parts by weight of butanol. Thus was formed an undercoat of 1 μm in thickness.

Then, 5 parts by weight of polyvinyl butyral (SLEK BM-2, Sekisui Chemical Co., Ltd.), 400 parts by weight of cyclohexanone, and 5 parts by weight of an azo pigment of the structural formula (I) indicated below were dispersed for 3 hours in a sand mill together with 600 parts by weight of glass beads of 1 mm in diameter to prepare a coating solution for formation of a charge generation layer.

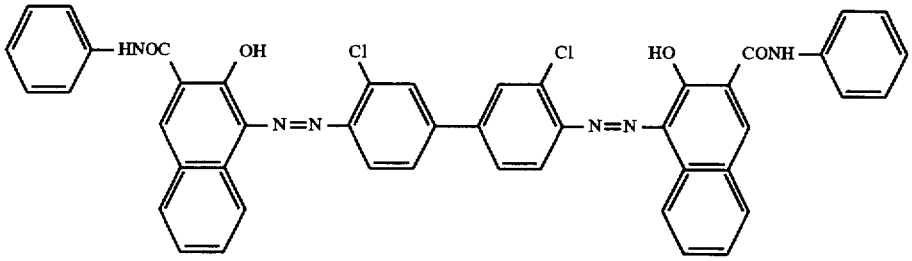

(I)

This coating solution was dip-coated onto the undercoat to form a charge generation layer having a dry-basis thickness of 0.2 μm.

Then, 10 parts by weight of a charge transporting agent of the structural formula (II) indicated below, 10 parts by weight of polycarbonate Z (Z-500, Teijin Kasei Kabushiki Kaisha), 0.5 part by weight of a compound of the formula ($A_1$−1), and 0.5 part by weight of a compound of the formula ($B_1$−1) were dissolved in 100 parts by weight of dichloromethane to prepare a coating solution for formation of a charge transport layer.

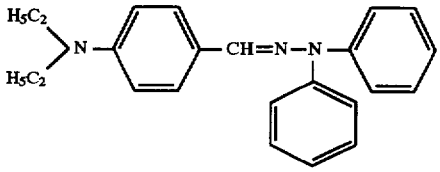

(II)

Figure 1:
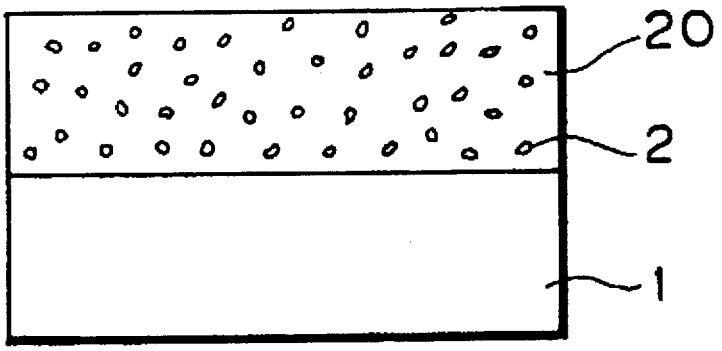
FIG. 1 is a sectional structural view showing a single-layer type photosensitive material.
Figure 2:
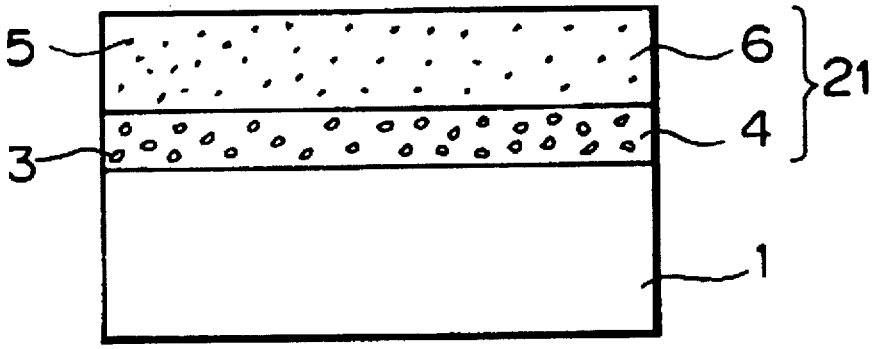
FIG. 2 is a sectional structural view showing a double-layered laminate type photosensitive material.

This coating solution was dip-coated onto the charge generation layer to form a charge transport layer having a dry-basis thickness of 20 μm. Thus was produced a photosensitive material of the laminate structure shown in FIG. 2.

COMPARATIVE EXAMPLE 1-1

A photosensitive material was produced in the same way as in Example 1-1 except that neither the compound of the formula ($A_1$−1) nor the compound of the formula ($B_1$−1) was added to the coating solution for formation of the charge transport layer.

EXAMPLES 1-2 TO 1-10 AND COMPARATIVE EXAMPLES 1-2 TO 1-10

Photosensitive materials of Examples 1-2 to 1-10 and Comparative Examples 1-2 to 1-10 were produced in the same way as in Example 1-1 except that the combination of the Group $A_1$ compound and the Group $B_1$ compound added to the coating solution for formation of the charge transport layer was replaced by each of the combinations shown in Table 1.

Each of the photosensitive materials was evaluated for characteristics by a photosensitive material evaluating machine. With the photosensitive material being rotated, its surface was charged to −800 V with a corotron. Then, the photosensitive material was allowed to stand for 5 seconds in the dark, and the dark decay retention rate in 5 seconds, $V_{k5}$ (%), was determined. Subsequently, halogen lamp light giving an illuminance of 2 lux and deprived of a wavelength of 650 nm or more was projected onto the photosensitive material, and the time taken until the charged potential decayed to −400 V was measured. Based on the quantity of exposure required until this decay was achieved, the sensitivity, $E_{1/2}$(lux·sec), was determined. Such measurements were performed initially and after the photosensitive material was allowed to stand for 12 hours in an atmosphere of 100 ppm ozone, thereby investigating changes in the characteristics due to exposure to ozone. The results are shown in Table 1.

TABLE 1

| | Compound incorporated in charge transport layer | | Characteristics | | | |
|---|---|---|---|---|---|---|
| | | | Initial | | After ozone exposure | |
| | Group A compound | Group B compound | $V_{k5}$ | $E_{1/2}$ | $V_{k5}$ | $E_{1/2}$ |
| Ex. 1-1 | $A_1$-1 | $B_1$-1 | 98 | 2.5 | 95 | 2.6 |
| Ex. 1-2 | $A_1$-2 | $B_1$-1 | 98 | 2.6 | 97 | 2.6 |
| Ex. 1-3 | $A_1$-3 | $B_1$-2 | 97 | 2.8 | 95 | 2.7 |
| Ex. 1-4 | $A_1$-4 | $B_1$-6 | 99 | 3.0 | 97 | 3.0 |
| Ex. 1-5 | $A_1$-5 | $B_1$-14 | 98 | 3.1 | 97 | 3.0 |
| Ex. 1-6 | $A_1$-6 | $B_1$-14 | 95 | 2.7 | 94 | 2.6 |
| Ex. 1-7 | $A_1$-7 | $B_1$-31 | 97 | 2.9 | 95 | 2.9 |
| Ex. 1-8 | $A_1$-8 | $B_1$-34 | 97 | 3.1 | 95 | 3.0 |
| Ex. 1-9 | $A_1$-10 | $B_1$-38 | 99 | 2.7 | 98 | 2.8 |
| Ex. 1-10 | $A_1$-11 | $B_1$-39 | 97 | 2.9 | 97 | 2.8 |
| Comp. Ex. 1-1 | — | — | 98 | 2.4 | 86 | 4.0 |
| Comp. Ex. 1-2 | — | $B_1$-1 | 99 | 2.6 | 90 | 3.1 |
| Comp. Ex. 1-3 | — | $B_1$-2 | 97 | 2.5 | 91 | 3.0 |
| Comp. Ex. 1-4 | — | $B_1$-6 | 96 | 2.4 | 89 | 2.9 |
| Comp. Ex. 1-5 | — | $B_1$-14 | 95 | 2.8 | 87 | 3.2 |
| Comp. Ex. 1-6 | — | $B_1$-31 | 99 | 2.7 | 91 | 3.1 |
| Comp. Ex. 1-7 | $A_1$-2 | — | 99 | 2.6 | 90 | 3.4 |
| Comp. Ex. 1-8 | $A_1$-3 | — | 98 | 2.4 | 91 | 3.2 |
| Comp. Ex. 1-9 | $A_1$-4 | — | 97 | 2.8 | 89 | 3.4 |
| Comp. Ex. 1-10 | $A_1$-5 | — | 98 | 2.6 | 91 | 3.4 |

As shown in Table 1, the photosensitive materials of the Examples in which hydrobenzoin compounds as the Group $A_1$ compounds and hindered phenols as the Group $B_1$ compounds were combined and incorporated in the charge transport layer underwent less change in characteristics owing to exposure to ozone than did the photosensitive materials of the Comparative Examples. Thus, it is clear that the deterioration of the photosensitive layer can be prevented by combining such compounds and incorporating the combinations into the charge transport layer.

EXAMPLES 2-1 TO 2-6 AND COMPARATIVE EXAMPLES 2-1 TO 2-9

Photosensitive materials of Examples 2-1 to 2-6 and Comparative Examples 2-1 to 2-9 were produced in the same way as in Example 1-1 except that the compounds added to the charge transport layer were changed as indicated in Table 2.

Each of the photosensitive materials was evaluated for characteristics in the same manner as in the case of the photosensitive materials of Example 1-1 and so forth. The results are shown in Table 2.

TABLE 2

| | Compound incorporated in charge transport layer | | Characteristics | | | |
|---|---|---|---|---|---|---|
| | | | Initial | | After ozone exposure | |
| | Group A compound | Group B compound | $V_{k5}$ | $E_{1/2}$ | $V_{k5}$ | $E_{1/2}$ |
| Ex. 2-1 | $A_1$-1 | $B_2$-3 | 98 | 2.4 | 96 | 2.6 |
| Ex. 2-2 | $A_1$-2 | $B_2$-1 | 98 | 2.5 | 97 | 2.5 |
| Ex. 2-3 | $A_1$-3 | $B_2$-2 | 98 | 2.7 | 95 | 2.8 |
| Ex. 2-4 | $A_1$-4 | $B_2$-6 | 99 | 2.9 | 97 | 3.0 |
| Ex. 2-5 | $A_1$-5 | $B_2$-14 | 97 | 3.1 | 98 | 3.1 |
| Ex. 2-6 | $A_1$-6 | $B_2$-14 | 96 | 2.7 | 95 | 2.6 |
| Comp. Ex. 2-1 | — | — | 97 | 2.5 | 85 | 4.0 |
| Comp. Ex. 2-2 | — | $B_2$-1 | 99 | 2.6 | 89 | 3.3 |
| Comp. Ex. 2-3 | — | $B_2$-2 | 98 | 2.4 | 91 | 3.0 |
| Comp. Ex. 2-4 | — | $B_2$-6 | 97 | 2.4 | 89 | 3.0 |
| Comp. Ex. 2-5 | — | $B_2$-14 | 97 | 2.7 | 88 | 3.2 |
| Comp. Ex. 2-6 | $A_1$-2 | — | 99 | 2.8 | 90 | 3.5 |
| Comp. Ex. 2-7 | $A_1$-3 | — | 99 | 2.5 | 90 | 3.2 |
| Comp. Ex. 2-8 | $A_1$-4 | — | 98 | 2.8 | 88 | 3.4 |
| Comp. Ex. 2-9 | $A_1$-5 | — | 98 | 2.7 | 91 | 3.3 |

As shown in Table 2, the photosensitive materials of the above Examples in which hydrobenzoin compounds as the Group $A_1$ compounds and quinones as the Group $B_2$ compounds were combined and incorporated in the charge transport layer underwent less change in characteristics owing to exposure to ozone, as in the case of Example 1, than did the photosensitive materials of the Comparative Examples. Thus, it is clear that the deterioration of the photosensitive layer can be prevented by combining such compounds and incorporating the combinations into the charge transport layer.

EXAMPLES 3-1 TO 3-10 AND COMPARATIVE EXAMPLES 3-1 TO 3-10

Photosensitive materials of Examples 3-1 to 3-10 and Comparative Examples 3-1 to 3-10 were produced in the same way as in Example 1-1 except that the compounds added to the charge transport layer were changed as indicated in Table 3.

Each of the photosensitive materials was evaluated for characteristics in the same manner as in the case of the photosensitive materials of Example 1-1 and so forth. The results are shown in Table 3.

TABLE 3

| | Compound incorporated in charge transport layer | | Characteristics | | | |
|---|---|---|---|---|---|---|
| | | | Initial | | After ozone exposure | |
| | Group A compound | Group B compound | $V_{k5}$ | $E_{1/2}$ | $V_{k5}$ | $E_{1/2}$ |
| Ex. 3-1 | $A_1$-1 | $B_3$-1 | 99 | 2.5 | 96 | 2.5 |
| Ex. 3-2 | $A_1$-2 | $B_3$-1 | 98 | 2.4 | 96 | 2.6 |
| Ex. 3-3 | $A_1$-3 | $B_3$-2 | 98 | 2.7 | 95 | 2.7 |
| Ex. 3-4 | $A_1$-4 | $B_3$-6 | 99 | 3.0 | 96 | 3.0 |
| Ex. 3-5 | $A_1$-5 | $B_3$-3 | 97 | 3.0 | 97 | 3.1 |
| Ex. 3-6 | $A_1$-6 | $B_3$-4 | 95 | 2.8 | 95 | 2.6 |
| Ex. 3-7 | $A_1$-7 | $B_3$-5 | 96 | 2.9 | 96 | 3.0 |
| Ex. 3-8 | $A_1$-8 | $B_3$-7 | 97 | 3.1 | 96 | 3.0 |

TABLE 3-continued

| | Compound incorporated in charge transport layer | | Characteristics | | | |
|---|---|---|---|---|---|---|
| | | | Initial | | After ozone exposure | |
| | Group A compound | Group B compound | $V_{k5}$ | $E_{1/2}$ | $V_{k5}$ | $E_{1/2}$ |
| Ex. 3-9 | $A_1$-10 | $B_3$-8 | 98 | 2.6 | 98 | 2.7 |
| Ex. 3-10 | $A_1$-11 | $B_3$-9 | 98 | 2.9 | 97 | 2.9 |
| Comp. Ex. 3-1 | — | — | 98 | 2.4 | 84 | 3.9 |
| Comp. Ex. 3-2 | — | $B_3$-1 | 97 | 2.6 | 91 | 3.1 |
| Comp. Ex. 3-3 | — | $B_3$-2 | 97 | 2.6 | 90 | 3.1 |
| Comp. Ex. 3-4 | — | $B_3$-6 | 97 | 2.4 | 89 | 2.9 |
| Comp. Ex. 3-5 | — | $B_3$-8 | 96 | 2.7 | 86 | 3.2 |
| Comp. Ex. 3-6 | — | $B_3$-9 | 98 | 2.7 | 90 | 3.1 |
| Comp. Ex. 3-7 | $A_1$-2 | — | 98 | 2.7 | 90 | 3.3 |
| Comp. Ex. 3-8 | $A_1$-3 | — | 98 | 2.3 | 91 | 3.2 |
| Comp. Ex. 3-9 | $A_1$-4 | — | 96 | 2.8 | 88 | 3.5 |
| Comp. Ex. 3-10 | $A_1$-5 | — | 98 | 2.5 | 90 | 3.4 |

As shown in Table 3, the photosensitive materials of the above Examples in which hydrobenzoin compounds as the Group $A_1$ compounds and hydroquinones as the Group $B_3$ compounds were combined and incorporated in the charge transport layer underwent less change in characteristics owing to exposure to ozone, as in the case of Example 1, than did the photosensitive materials of the Comparative Examples. Thus, it is clear that the deterioration of the photosensitive layer can be prevented by combining such compounds and incorporating the combinations into the charge transport layer.

EXAMPLES 4-1 TO 4-6 AND COMPARATIVE EXAMPLES 4-1 TO 4-9

Photosensitive materials of Examples 4-1 to 4-6 and Comparative Examples 4-1 to 4-9 were produced in the same way as in Example 1-1 except that the compounds added to the charge transport layer were changed as indicated in Table 4.

Each of the photosensitive materials was evaluated for characteristics in the same manner as in the case of the photosensitive materials of Example 1-1 and so forth. The results are shown in Table 4.

TABLE 4

| | Compound incorporated in charge transport layer | | Characteristics | | | |
|---|---|---|---|---|---|---|
| | | | Initial | | After ozone exposure | |
| | Group A compound | Group B compound | $V_{k5}$ | $E_{1/2}$ | $V_{k5}$ | $E_{1/2}$ |
| Ex. 4-1 | $A_2$-1 | $B_1$-1 | 99 | 2.6 | 95 | 2.6 |
| Ex. 4-2 | $A_2$-2 | $B_1$-1 | 98 | 2.5 | 97 | 2.6 |
| Ex. 4-3 | $A_2$-3 | $B_1$-2 | 98 | 2.7 | 95 | 2.7 |
| Ex. 4-4 | $A_2$-4 | $B_1$-6 | 99 | 3.0 | 97 | 3.1 |
| Ex. 4-5 | $A_2$-5 | $B_1$-14 | 97 | 3.1 | 97 | 3.1 |
| Ex. 4-6 | $A_2$-6 | $B_1$-14 | 96 | 2.7 | 95 | 2.7 |
| Comp. Ex. 4-1 | — | — | 98 | 2.5 | 85 | 4.0 |
| Comp. Ex. 4-2 | — | $B_1$-1 | 99 | 2.5 | 90 | 3.2 |
| Comp. Ex. 4-3 | — | $B_1$-2 | 98 | 2.6 | 90 | 3.0 |
| Comp. Ex. 4-4 | — | $B_1$-6 | 96 | 2.5 | 87 | 3.0 |
| Comp. Ex. 4-5 | — | $B_1$-14 | 96 | 2.7 | 88 | 3.2 |

TABLE 4-continued

| | Compound incorporated in charge transport layer | | Characteristics | | | |
|---|---|---|---|---|---|---|
| | | | Initial | | After ozone exposure | |
| | Group A compound | Group B compound | $V_{k5}$ | $E_{1/2}$ | $V_{k5}$ | $E_{1/2}$ |
| Comp. Ex. 4-6 | $A_2$-2 | — | 99 | 2.6 | 89 | 3.3 |
| Comp. Ex. 4-7 | $A_2$-3 | — | 98 | 2.5 | 90 | 3.1 |
| Comp. Ex. 4-8 | $A_2$-4 | — | 97 | 2.7 | 88 | 3.3 |
| Comp. Ex. 4-9 | $A_2$-5 | — | 97 | 2.6 | 90 | 3.4 |

As shown in Table 4, the photosensitive materials of the above Examples in which hydrobenzoin compounds as the Group $A_2$ compounds and hindered phenols as the Group $B_1$ compounds were combined and incorporated in the charge transport layer underwent less change in characteristics owing to exposure to ozone, as in the case of Example 1, than did the photosensitive materials of the Comparative Examples. Thus, it is clear that the deterioration of the photosensitive layer can be prevented by combining such compounds and incorporating the combinations into the charge transport layer.

EXAMPLES 5-1 TO 5-6 AND COMPARATIVE EXAMPLES 5-1 TO 5-9

Photosensitive materials of Examples 5-1 to 5-6 and Comparative Examples 5-1 to 5-9 were produced in the same way as in Example 1-1 except that the compounds added to the charge transport layer were changed as indicated in Table 5.

Each of the photosensitive materials was evaluated for characteristics in the same manner as in the case of the photosensitive materials of Example 1-1 and so forth. The results are shown in Table 5.

TABLE 5

| | Compound incorporated in charge transport layer | | Characteristics | | | |
|---|---|---|---|---|---|---|
| | | | Initial | | After ozone exposure | |
| | Group A compound | Group B compound | $V_{k5}$ | $E_{1/2}$ | $V_{k5}$ | $E_{1/2}$ |
| Ex. 5-1 | $A_2$-1 | $B_2$-3 | 99 | 2.5 | 95 | 2.6 |
| Ex. 5-2 | $A_2$-2 | $B_2$-1 | 99 | 2.5 | 98 | 2.5 |
| Ex. 5-3 | $A_2$-3 | $B_2$-2 | 97 | 2.7 | 95 | 2.7 |
| Ex. 5-4 | $A_2$-4 | $B_2$-6 | 98 | 3.0 | 96 | 3.0 |
| Ex. 5-5 | $A_2$-5 | $B_2$-14 | 98 | 3.0 | 97 | 3.1 |
| Ex. 5-6 | $A_2$-6 | $B_2$-14 | 97 | 2.7 | 95 | 2.7 |
| Comp. Ex. 5-1 | — | — | 98 | 2.5 | 86 | 4.0 |
| Comp. Ex. 5-2 | — | $B_2$-1 | 98 | 2.5 | 90 | 3.0 |
| Comp. Ex. 5-3 | — | $B_2$-2 | 98 | 2.6 | 91 | 3.0 |
| Comp. Ex. 5-4 | — | $B_2$-6 | 96 | 2.4 | 87 | 3.0 |
| Comp. Ex. 5-5 | — | $B_2$-14 | 96 | 2.7 | 88 | 3.1 |
| Comp. Ex. 5-6 | $A_2$-2 | — | 98 | 2.7 | 90 | 3.5 |
| Comp. Ex. 5-7 | $A_2$-3 | — | 98 | 2.4 | 89 | 3.3 |
| Comp. Ex. 5-8 | $A_2$-4 | — | 99 | 2.8 | 89 | 3.5 |
| Comp. Ex. 5-9 | $A_2$-5 | — | 97 | 2.7 | 87 | 3.4 |

As shown in Table 5, the photosensitive materials of the above Examples in which hydrobenzoin compounds as the Group $A_2$ compounds and quinones as the Group $B_2$ compounds were combined and incorporated in the charge transport layer underwent less change in characteristics owing to exposure to ozone, as in the case of Example 1, than did the photosensitive materials of the Comparative Examples. Thus, it is clear that the deterioration of the photosensitive layer can be prevented by combining such compounds and incorporating the combinations into the charge transport layer.

EXAMPLES 6-1 TO 6-6 AND COMPARATIVE EXAMPLES 6-1 TO 6-9

Photosensitive materials of Examples 6-1 to 6-6 and Comparative Examples 6-1 to 6-9 were produced in the same way as in Example 1-1 except that the compounds added to the charge transport layer were changed as indicated in Table 6.

Each of the photosensitive materials was evaluated for characteristics in the same manner as in the case of the photosensitive materials of Example 1-1 and so forth. The results are shown in Table 6.

TABLE 6

| | Compound incorporated in charge transport layer | | Characteristics | | | |
|---|---|---|---|---|---|---|
| | | | Initial | | After ozone exposure | |
| | Group A compound | Group B compound | $V_{k5}$ | $E_{1/2}$ | $V_{k5}$ | $E_{1/2}$ |
| Ex. 6-1 | $A_2$-1 | $B_3$-4 | 98 | 2.4 | 96 | 2.5 |
| Ex. 6-2 | $A_2$-2 | $B_3$-3 | 99 | 2.6 | 98 | 2.6 |
| Ex. 6-3 | $A_2$-3 | $B_3$-2 | 99 | 2.7 | 98 | 2.8 |
| Ex. 6-4 | $A_2$-4 | $B_3$-6 | 99 | 3.0 | 98 | 3.1 |
| Ex. 6-5 | $A_2$-5 | $B_3$-5 | 98 | 3.0 | 97 | 3.0 |
| Ex. 6-6 | $A_2$-6 | $B_3$-5 | 96 | 2.7 | 95 | 2.6 |
| Comp. Ex. 6-1 | — | — | 98 | 2.4 | 84 | 3.9 |
| Comp. Ex. 6-2 | — | $B_3$-1 | 99 | 2.6 | 88 | 3.1 |
| Comp. Ex. 6-3 | — | $B_3$-2 | 98 | 2.4 | 90 | 3.0 |
| Comp. Ex. 6-4 | — | $B_3$-6 | 97 | 2.4 | 88 | 3.0 |
| Comp. Ex. 6-5 | — | $B_3$-5 | 97 | 2.7 | 87 | 3.2 |
| Comp. Ex. 6-6 | $A_2$-2 | — | 99 | 2.5 | 88 | 3.4 |
| Comp. Ex. 6-7 | $A_2$-3 | — | 99 | 2.5 | 89 | 3.2 |
| Comp. Ex. 6-8 | $A_2$-4 | — | 98 | 2.8 | 89 | 3.5 |
| Comp. Ex. 6-9 | $A_2$-5 | — | 97 | 2.6 | 91 | 3.5 |

As shown in Table 6, the photosensitive materials of the above Examples in which hydrobenzoin compounds as the Group $A_2$ compounds and hydroquinones as the Group $B_3$ compounds were combined and incorporated in the charge transport layer underwent less change in characteristics owing to exposure to ozone, as in the case of Example 1, than did the photosensitive materials of the Comparative Examples. Thus, it is clear that the deterioration of the photosensitive layer can be prevented by combining such compounds and incorporating the combinations into the charge transport layer.

The above embodiments describe the photosensitive materials having the charge generation layer and the charge transport layer laminated on the electroconductive substrate in this order. However, the order of laminating may be reversed. In this case as well, the same effects can be obtained by adding the above-mentioned compounds to the charge transport layer. Single-layered photosensitive materials may also be included in the embodiments of the present invention. In this case, it suffices to incorporate the aforementioned compounds into the entire single photosensitive layer.

According to the present invention, there can be obtained a photosensitive material having excellent electrical characteristics, and markedly improved stability in characteristics even during long-term repeated use, by incorporating a combination of at least one member selected from the aforementioned Group A compounds and at least one member selected from the aforementioned Group B compounds into a layer containing a hole charge transporting agent in a photosensitive material at least having this layer on an electroconductive substrate.

The present invention has been described in detail with respect to preferred embodiments, and it will now be clear that changes and modifications may be made without departing from the invention in its broader aspects, and it is our intention, therefore, in the appended claims to cover all such changes and modifications as fall within the true spirit of the invention.

What is claimed is:

1. An electrophotographic photoconductor, comprising:

an electroconductive substrate; and a photosensitive layer which is provided on said electroconductive substrate and which comprises a charge generating layer containing a charge generating agent and a charge transporting layer containing a hole charge transporting agent, and antioxidant comprised of at least two antioxidant materials, wherein the antioxidant comprised of at least two antioxidant materials contains:

(a) at least one hydrobenzoin compound of formula ($A_1$):

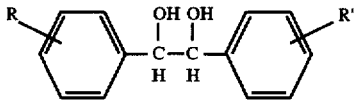

($A_1$)

wherein R and R' are independently selected from the group consisting of a hydrogen atom, a halogen atom, a cyano group, a nitro group, an alkyl group optionally having a substituent, an alkoxy group optionally having a substituent, an aryl group optionally having a substituent, and an aralkyl group optionally having a substituent, and (b) at least one hindered phenol of formula ($B_1$):

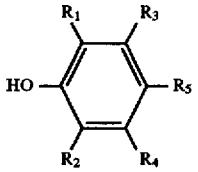

($B_1$)

wherein $R_1$ to $R_5$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

2. An electrophotographic photoconductor, comprising:

an electroconductive substrate; and a photosensitive layer which is provided on said electroconductive substrate and which comprises a charge generating layer containing a charge generating agent and a charge transporting layer containing a hole charge transporting agent, and antioxidant comprised of at least two antioxidant materials, wherein the antioxidant comprised of at least two antioxidant materials contains:

(a) at least one hydrobenzoin compound of formula ($A_1$):

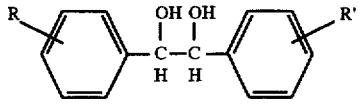

($A_1$)

wherein R and R' are independently selected from the group consisting of a hydrogen atom, a halogen atom, a cyano group, a nitro group, an alkyl group optionally having a substituent, an alkoxy group optionally having a substituent, an aryl group optionally having a substituent, and an aralkyl group optionally having a substituent, and (b) at least one quinone of any of formulae ($B_2$):

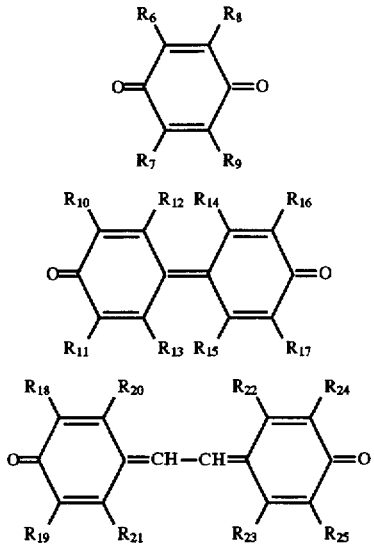

($B_2$)

wherein $R_6$ to $R_{25}$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, atkyloxycarbonyl, aryloxcarbonyl, alkylacyloxy, arylacyloxy, silyl, or heterocyclic group.

3. An electrophotographic photoconductor, comprising:

an electroconductive substrate; and a photosensitive layer which is provided on said electroconductive substrate and which comprises a charge generating layer containing a charge generating agent and a charge transporting layer containing a hole charge transporting agent, and antioxidant comprised of at least two antioxidant materials, wherein the antioxidant comprised of at least two antioxidant materials contains:

(a) at least one hydrobenzoin compound of formula ($A_1$):

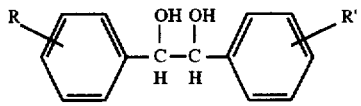

($A_1$)

wherein R and R' are independently selected from the group consisting of a hydrogen atom, a halogen atom, a cyano group, a nitro group, an alkyl group optionally having a substituent, an alkoxy group optionally having a substituent, an aryl group optionally having a substituent, and an aralkyl group optionally having a substituent, and (b) at least one hydroquinone of formula ($B_3$):

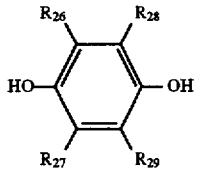

($B_3$)

wherein $R_{26}$ to $R_{29}$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

4. An electrophotographic photoconductor, comprising:

an electroconductive substrate; and a photosensitive layer which is provided on said electroconductive substrate and which comprises a charge generating layer containing a charge generating agent and a charge transporting layer containing a hole charge transporting agent, and antioxidant comprised of at least two antioxidant materials, wherein the antioxidant comprised of at least two antioxidant materials contains:

(a) at least one hydrobenzoin compound of formula ($A_2$):

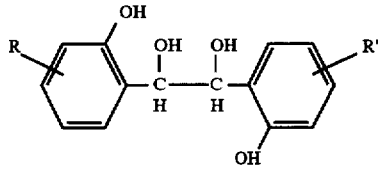

($A_2$)

wherein R and R' are independently selected from the group consisting of a hydrogen atom, a halogen atom, a cyano group, a nitro group, an alkyl group optionally having a substituent, an alkoxy group optionally having a substituent, an aryl group optionally having a substituent, and an aralkyl group optionally having a substituent, and (b) at least one hindered phenol of formula ($B_1$):

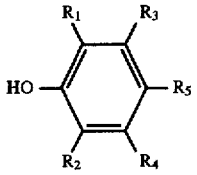

($B_1$)

wherein $R_1$ to $R_4$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

5. An electrophotographic photoconductor, comprising:

an electroconductive substrate; and a photosensitive layer which is provided on said electroconductive substrate and which comprises a charge generating layer containing a charge generating agent and a charge transporting layer containing a hole charge transporting agent, and antioxidant comprised of at least two antioxidant materials, wherein the antioxidant comprised of at least two antioxidant materials contains:

(a) at least one hydrobenzoin compound of formula ($A_2$):

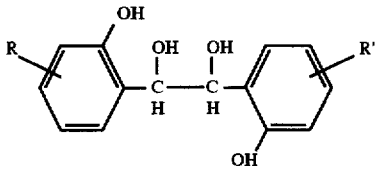

($A_2$)

wherein R and R' are independently selected from the group consisting of a hydrogen atom, a halogen atom, a cyano group, a nitro group, an alkyl group optionally having a substituent, an alkoxy group optionally having a substituent, an aryl group optionally having a substituent, and an aralkyl group optionally having a substituent, and (b) at least one quinone of any of formulae ($B_2$):

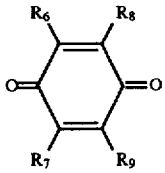

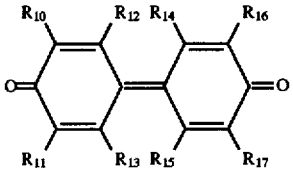

-continued

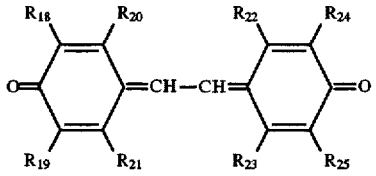

(B₂)

wherein $R_1$ to $R_{25}$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

6. An electrophotographic photoconductor, comprising:

an electroconductive substrate; and a photosensitive layer which is provided on said electroconductive substrate and which comprises a charge generating layer containing a charge generating agent and a charge transporting layer containing a hole charge transporting agent, and antioxidant comprised of at least two antioxidant materials, wherein the antioxidant comprised of at least two antioxidant materials contains:

(a) at least one hydrobenzoin compound of formula ($A_2$):

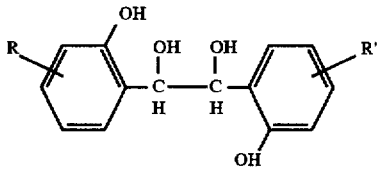

(A₂)

wherein R and R' are independently selected from the group consisting of a hydrogen atom, a halogen atom, a cyano group, a nitro group, an alkyl group optionally having a substituent, an alkoxy group optionally having a substituent, an aryl group optionally having a substituent, and an aralkyl group optionally having a substituent, and (b) at least one hydroquinone of formula ($B_3$):

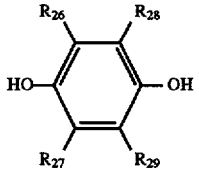

(B₃)

wherein $R_{26}$ to $R_{29}$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

7. An electrophotographic photoconductor, comprising:

an electroconductive substrate; and a photosensitive layer which is provided on said electroconductive substrate and which comprises a charge generating agent, a hole charge transporting agent and antioxidant comprised of at least two antioxidant materials, wherein the antioxidant comprised of at least two antioxidant materials contains:

(a) at least one hydrobenzoin compound of formula ($A_1$):

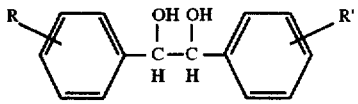

(A₁)

wherein R and R' are independently selected from the group consisting of a hydrogen atom, a halogen atom, a cyano group, a nitro group, and alkyl group optionally having a substituent, an aryl group optionally having a substituent, and an aralkyl group optionally having a substituent, and (b) at least one hindered phenol of formula ($B_1$):

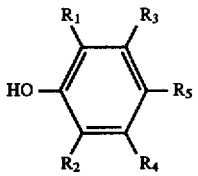

(B₁)

wherein $R_1$ to $R_5$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

8. An electrophotographic photoconductor, comprising:

an electroconductive substrate; and a photosensitive layer which is provided on said electroconductive substrate and which comprises a charge generating agent, a hole charge transporting agent, and antioxidant comprised of at least two antioxidant materials, wherein the antioxidant comprised of at least two antioxidant materials contains:

(a) at least one hydrobenzoin compound of formula ($A_1$):

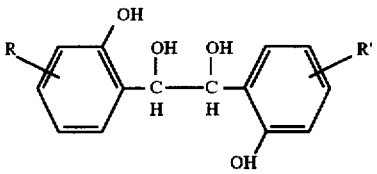

(A1)

wherein R and R' are independently selected from the group consisting of a hydrogen atom, a halogen atom, a cyano group, a nitro group, an alkyl group optionally having a substituent, an alkoxy group optionally having a substituent, an aryl group optionally having a substituent, and an aralkyl group optionally having a substituent, and (b) at least one quinone of any of formulae ($B_2$):

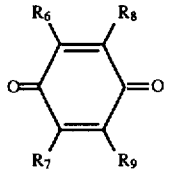

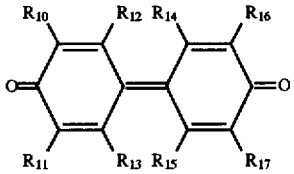

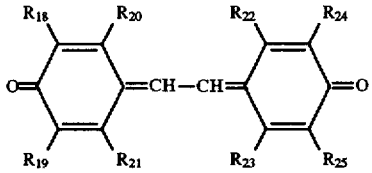

(B2)

wherein $R_6$ to $R_{25}$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

9. An electrophotographic photoconductor, comprising:

an electroconductive substrate; and a photosensitive layer which is provided on said electroconductive substrate and which comprises a charge generating agent, a hole charge transporting agent, and antioxidant comprised of at least two antioxidant materials, wherein the antioxidant comprised of at least two antioxidant materials contains:

(a) at least one hydrobenzoin compound of formula ($A_1$):

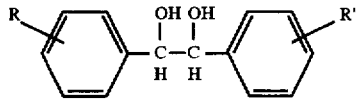

(A1)

wherein R and R' are independently selected from the group consisting of a hydrogen atom, a halogen atom, a cyano group, a nitro group, an alkyl group optionally having a substituent, an alkoxy group optionally having a substituent, and an aralkyl group optionally having a substituent, and (b) at least one hydroquinone of formula ($B_3$):

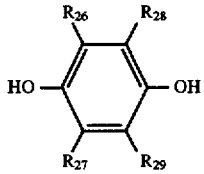

(B3)

wherein $R_{26}$ to $R_{29}$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

10. An electrophotographic photoconductor, comprising:

an electroconductive substrate; and a photosensitive layer which is provided on said electroconductive substrate and which comprises a charge generating agent, a hole charge transporting agent, and antioxidant comprised of at least two antioxidant materials, wherein the antioxidant comprised of at least two antioxidant materials contains:

(a) at least one hydrobenzoin compound of formula ($A_2$):

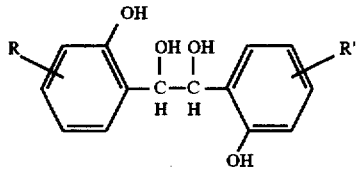

(A2)

wherein R and R' are independently selected from the group consisting of a hydrogen atom, a halogen atom, a cyano group, a nitro group, an alkyl group optionally having a substituent, an alkoxy group optionally having a substituent, and an aralkyl group optionally having a substituent, and (b) at least one hindered phenol of formula ($B_1$):

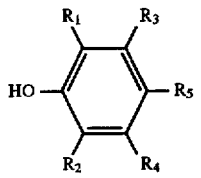

($B_1$)

wherein $R_1$ to $R_4$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

11. An electrophotographic photoconductor, comprising:

an electroconductive substrate; and a photosensitive layer which is provided on said electroconductive substrate and which comprises a charge generating agent, a hole charge transporting agent, and antioxidant comprised of at least two antioxidant materials, wherein the antioxidant comprised of at least two antioxidant materials contains:

(a) at least one hydrobenzoin compound of formula ($A_2$):

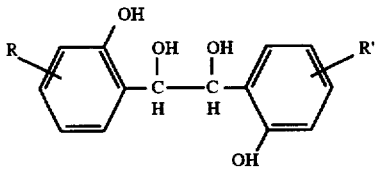

($A_2$)

wherein R and R' are independently selected from the group consisting of a hydrogen atom, a halogen atom, a cyano group, a nitro group, an alkyl group optionally having a substituent, an alkoxy group optionally having a substituent, an aryl group optionally having a substituent, and an aralkyl group optionally having a substituent, and (b) at least one quinone of any of formulae ($B_2$):

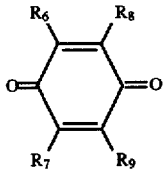

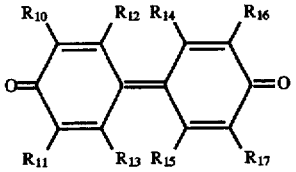

-continued

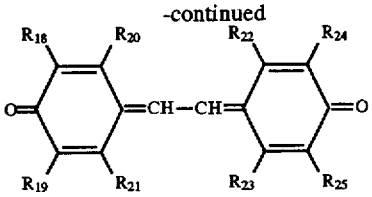

($B_2$)

wherein $R_1$ to $R_{25}$ are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

12. An electrophotographic photoconductor, comprising:

an electroconductive substrate; and a photosensitive layer which is provided on said electroconductive substrate and which comprises a charge generating agent, a hole charge transporting agent, and antioxidant comprised of at least two antioxidant materials, wherein the antioxidant comprised of at least two antioxidant materials contains:

(a) at least one hydrobenzoin compound of formula ($A_2$):

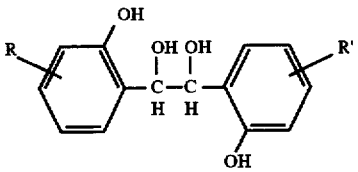

($A_2$)

wherein R and R' are independently selected from the group consisting of a hydrogen atom, a halogen atom, a cyano group, a nitro group, an alkyl group optionally having a substituent, an alkoxy group optionally having a substituent, an aryl group optionally having a substituent, and an aralkyl group optionally having a substituent, and (b) at least one hydroquinone of formula ($B_3$):

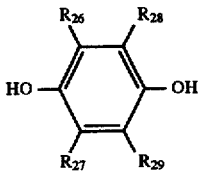

($B_3$)

wherein $R_{26}$ to $R_{29}$, are independently selected from the group consisting of a hydrogen atom, a halogen atom, a substituted or unsubstituted alkenyl group, a substituted or unsubstituted aryl group, a substituted or unsubstituted cycloalkyl group, a substituted or unsubstituted alkoxy group, and a substituted or unsubstituted aryloxy, alkylthio, arylthio, alkylamino, arylamino, acyl, alkylacylamino, arylacylamino, alkylcarbamoyl, arylcarbamoyl, alkylsulfonamide, arylsulfonamide, alkylsulfamoyl, arylsulfamoyl, alkylsulfonyl, arylsulfonyl, alkyloxycarbonyl, aryloxcarbonyl, alkylacyloxy, arylacyloxy, silyl, or heterocyclic group.

* * * * *